United States Patent [19]

Walter

[11] Patent Number: 4,890,749

[45] Date of Patent: Jan. 2, 1990

[54] DECORATIVE CLOTHES STAND

[75] Inventor: Herbert Walter, Müllheim, Fed. Rep. of Germany

[73] Assignee: Protoned, B.V., Amsterdam, Netherlands

[21] Appl. No.: 141,008

[22] Filed: Jan. 5, 1988

[30] Foreign Application Priority Data

Jan. 19, 1987 [CH] Switzerland ..... 176/87

[51] Int. Cl.[4] ..... A47F 5/00

[52] U.S. Cl. ..... 211/189; 211/182; 211/204

[58] Field of Search ..... 211/189, 13, 182, 204, 211/207, 208

[56] References Cited

U.S. PATENT DOCUMENTS

| | | | |
|---|---|---|---|
| 989,630 | 4/1911 | Moschocwitz | 211/13 X |
| 1,823,840 | 9/1931 | Nolte | 211/189 |
| 2,911,110 | 11/1959 | Drucker | 211/189 X |
| 4,068,855 | 1/1978 | Hackett | 211/189 X |
| 4,380,298 | 4/1983 | Harig | 211/189 |
| 4,627,544 | 12/1986 | Scarpa et al. | 211/189 |

FOREIGN PATENT DOCUMENTS

| | | | |
|---|---|---|---|
| 181584 | 5/1986 | European Pat. Off. | 211/13 |
| 2088205 | 6/1982 | United Kingdom | 211/13 |

*Primary Examiner*—Alvin C. Chin-Shue

*Attorney, Agent, or Firm*—Brumbaugh, Graves, Donohue & Raymond

[57] ABSTRACT

To decoratively present matching articles of clothing (11; 21–25), a clothes stand is proposed in which column members (1, 1.1', 1.1''), of a multicolumn stand consist of tubular columns (1) connected by cross-pieces (13, 14', 14'') to form column pairs (1.1). The upper ends of the tubular columns (1) are provided with end members, mechanically strengthening their end areas, in such a way that these areas and the cross pieces (13, 14', 14'') form coupling areas for mounting the attachment elements (9, 15–17, 19, 20) for the articles of clothing to be presented.

3 Claims, 6 Drawing Sheets

Figure 4A:
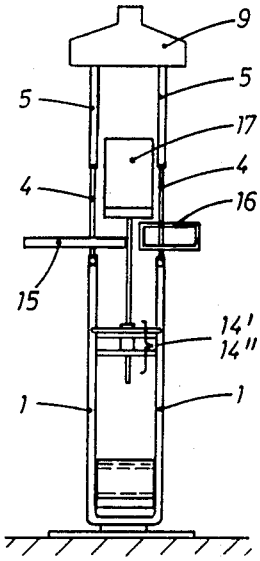

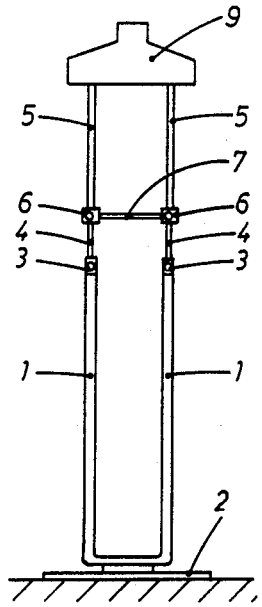
Fig. 1 a
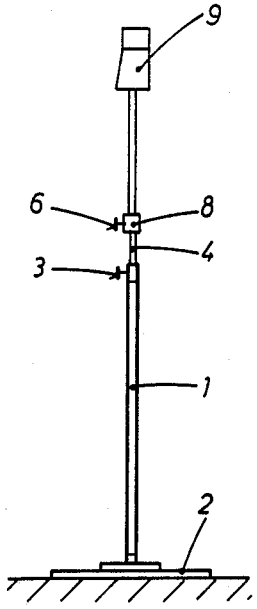
Fig. 1 b
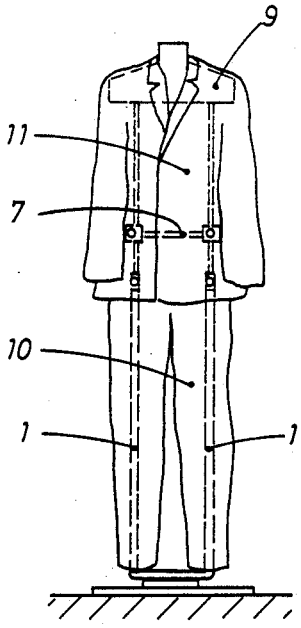
Fig. 1 c
Fig. 2
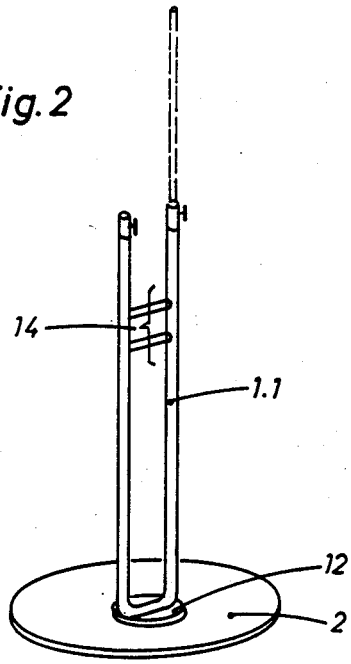
Fig. 3
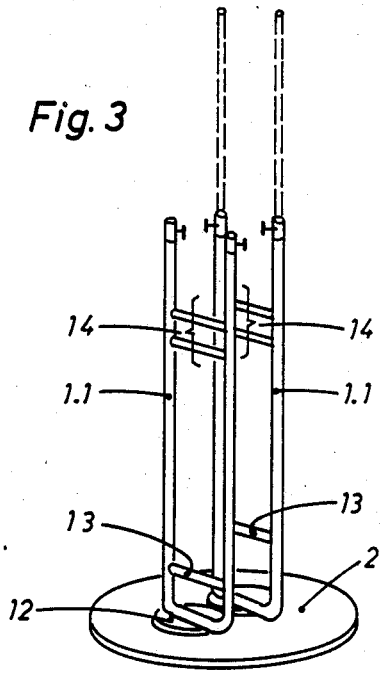

5
27
4
26
1; 1.1
5'
5

28'''
28''
28
6
28'
26
4
3
26
29'
15
21
30'

29
15
21
30
30
1; 1.1
1; 1.1

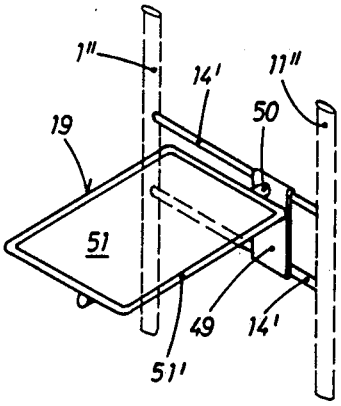
Fig. 11
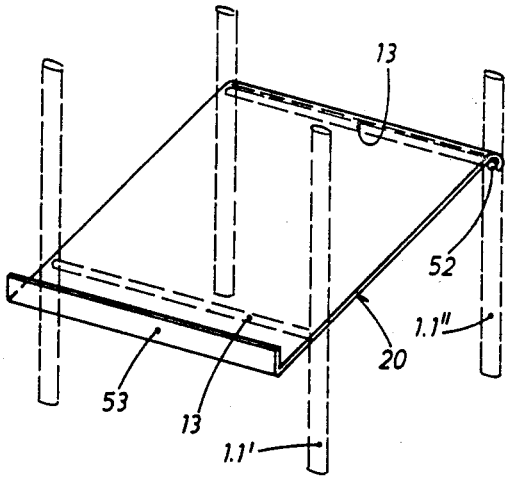
Fig. 12
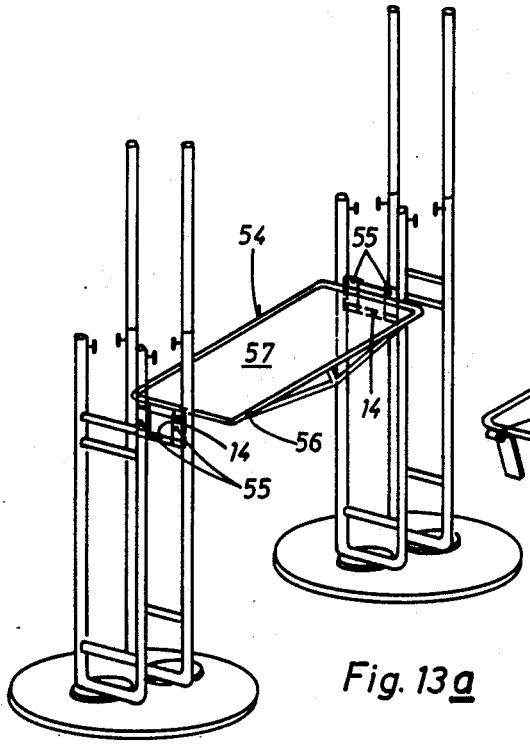
Fig. 13a
Fig. 13b
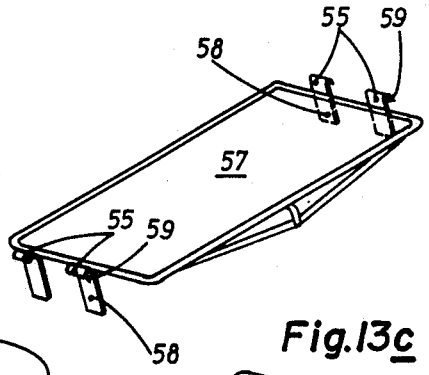
Fig. 13c
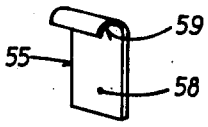

DECORATIVE CLOTHES STAND

The invention relates a decorative clothes stand according to the preamble of patent claim 1.

For the decorative presentation of articles of clothing and accessories, it is the normal practice to u use display dummies to which separate aids in the form of stands and/or shaped bodies are allocated for showing clothing extras such as shirts, ties, etc. If, for example, an alternative pair of trousers or an alternative jacket for a suit is to be presented, a plurality of decorative aids, which in many cases are suitable only for a limited range of application and occupy considerable storage space when not in use, are required for this purpose. In addition, such decorative aids and in particular display dummies are usually only suitable for the presentation of clothing in display windows and demonstration areas and cannot be used in sales areas.

The aim of the invention is therefore to create a decorative clothes stand which can be used in a versatile manner and on which not only entire suits but also a number of accessory articles to be offered therewith such as a second pair of trousers, a sports jacket, shoes and the like, can be presented advantageously in a small space.

The object resulting therefrom is to propose a multi-column stand which is constructed from tubular- column-elements arranged in pairs and in which the columns can be occupied by bearing means such as brackets, trays, bust elements and the like and are in a fixed or mutually adjustable arrangement on a common base element.

This object is achieved according to the invention by the characterizing part of claim 1. Embodiments thereof are defined by the dependent claims.

The advantages of the decorative clothes stand according to the invention are in particular its adaptability to specific presentation requirements of articles of clothing of every type, its usefulness for both window displays and in sales areas for demonstrating clothing combinations, and, when not in use, a relatively small requirement for storage space owing to removable supporting and bearing elements.

Figure 4B:
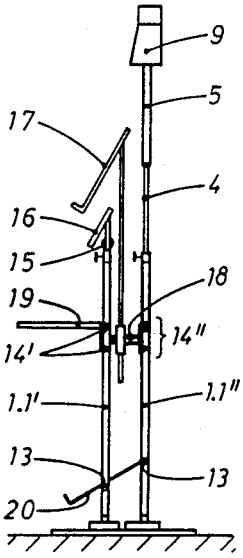
Figure 4C:
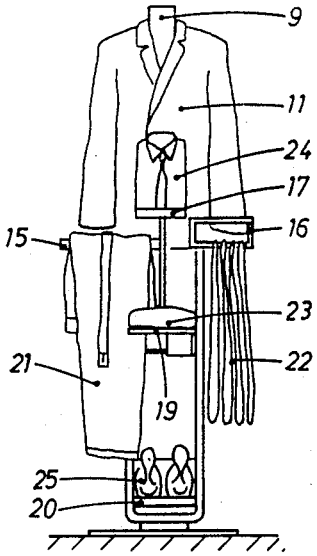
Figure 5A:
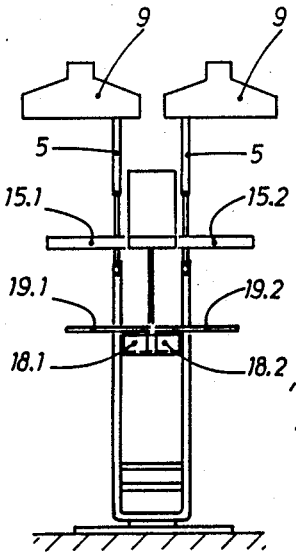
Figure 5B:
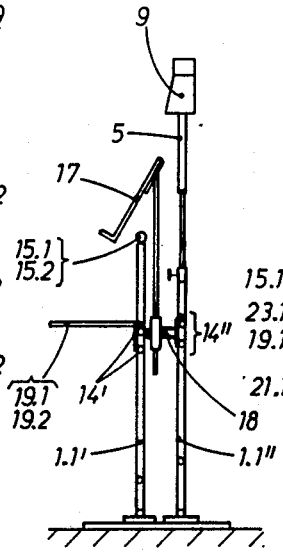
Figure 5C:
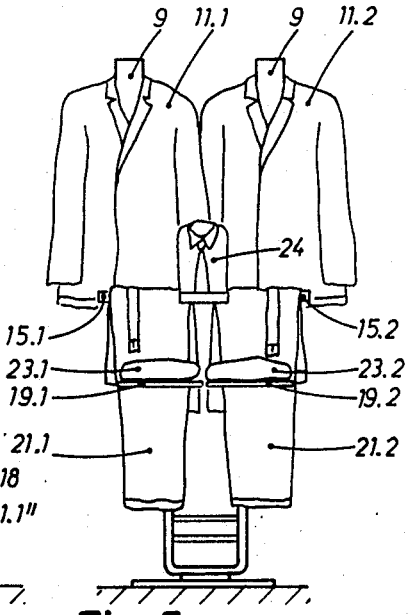
Figures 6A, 6B, 7A, 7B:
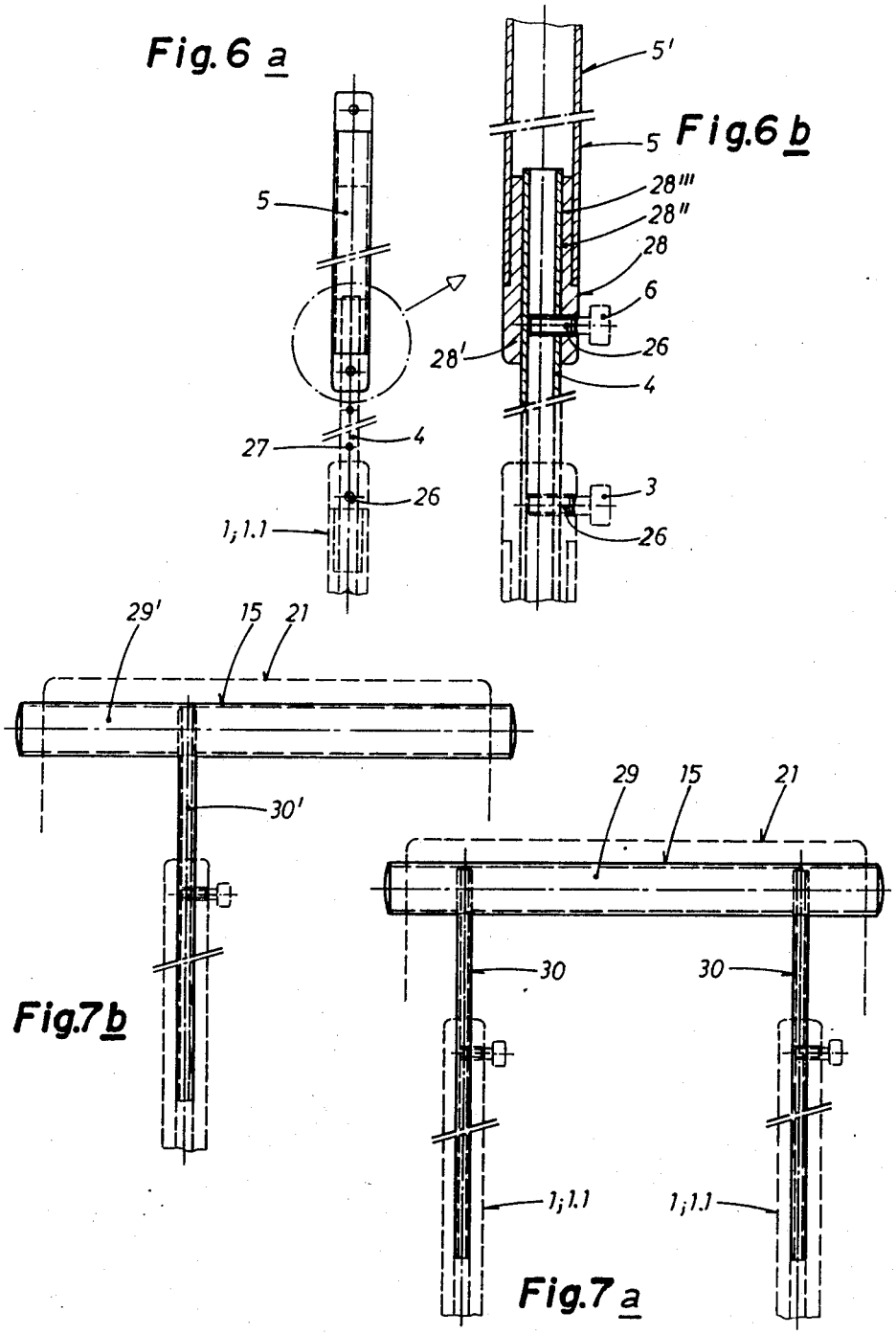
Figure 8:
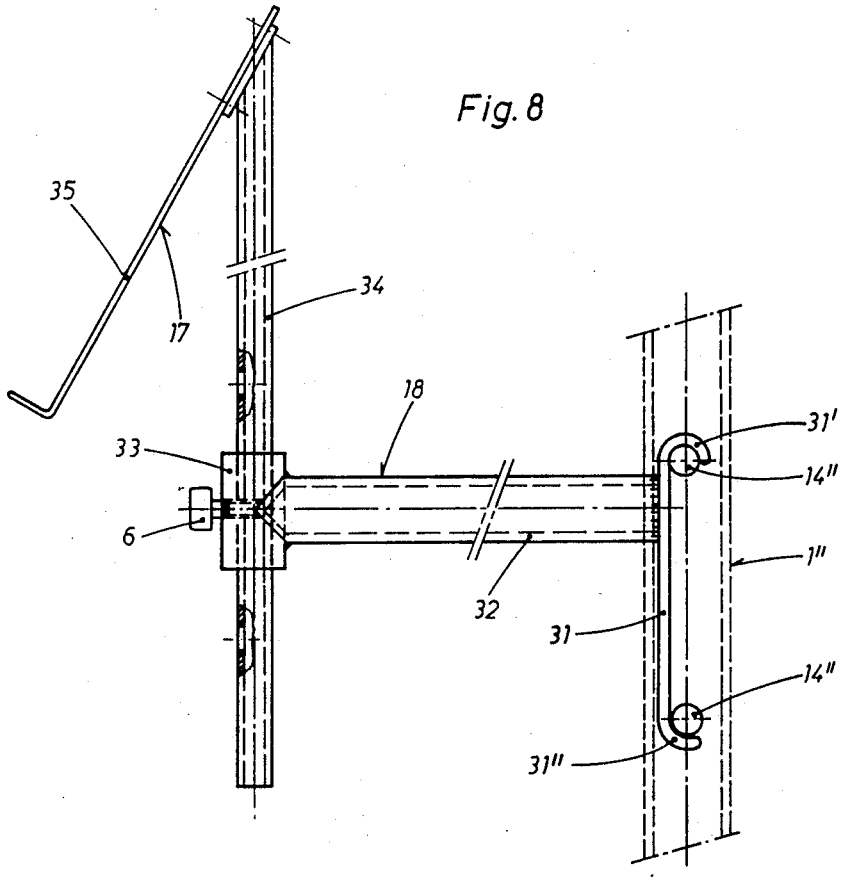
Figure 9B:
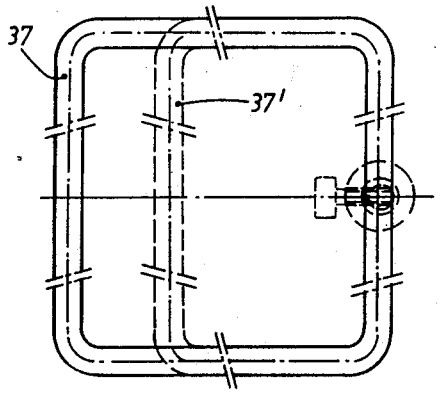
Figure 9A:
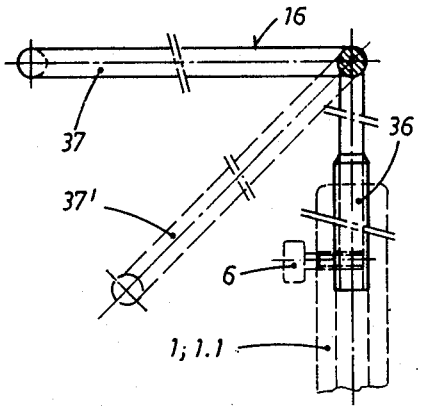

Exemplary embodiments of the subject-matter of the invention are described below with reference to the drawing, in which:

FIGS. 1*a–c* schematically show a simple embodiment of a decorative clothes stand according to the invention with a single column pair in (a) front view and (b) side view together with a shaped clothes hanger mounted with extension means thereupon, e.g. according to FIG. 10, and also (c) a schematic representation of a suit presented on this clothes stand, FIG. 2 shows a column structure similar to FIG. 1 with transverse members, inserted between the two columns of a column pair, for hanging tray elements etc., e.g. according to FIGS. 8 and 11–13, FIG. 3 shows a second embodiment of the column structure according to FIG. 2 with two column pairs which are arranged in twin relationship and are formed from columns connected together by means of transverse members, FIGS. 4*a–c* schematically show a decorative clothes-stand with a column structure according to FIG. 3 with attachment elements mounted thereon in (a) front view and (b) side view together with a shaped clothes-hanger, e.g. according to FIG. 10, mounted with extension means onto the rear columns of the column structure, and also (c) a schematic representation of the clothes-stand with articles of clothing presented thereon, FIGS. 5*a–c* show a decorative clothes stand with a column structure according to FIG. 3 and attachment elements partly different from those in FIG. 4, in (a) front view, (b) side view, and (c) a schematic representation of the clothes stand with articles of clothing presented thereon, FIGS. 6*a, b* show a column extension in elevation (a) and enlarged cross-sectional representation (b), FIGS. 7*a, b* show examples for the design of trouser rests (trouser hangers), FIG. 8 shows a shirt tray in side view together with an example for a shirt tray support which can be hung on double cross pieces of a column pair, FIGS. 9*a, b* show a tie hanger in side view and in plan view, FIGS. 10*a–d* show a shaped clothes hanger in plan view (a), in partially sectioned front view (b) and in side view (c), and also a section (d) along line D—D in FIG. 10, FIG. 11 perspectively shows a front tray in the hanging position on the double cross pieces of a column pair, FIG. 12 perspectively shows a shoe tray in the fitted position on a column structure according to FIG. 3, and FIG. 13 shows a connecting tray provided for fitting between two decorative stands, e.g. according to FIGS. 4 and 5, on the double cross pieces, for producing a stand combination of two or more decorative stands of the type shown.

The same reference numberals in the Figures designate the same or identical components.

Shown in front and side view in FIGS. 1*a* and 1*b* is a simple embodiment of a decorative clothes stand according to the invention in which, two individual tubular columns 1 are mounted onto a bottom plate 2 which stabilizes the tubular columns 1.1. Next to its upper end, each tubular column 1 has an adjusting screw 3 by which an extension tube 4 can be longitudinally displaced and firmly clamped in the tubular column. Details of the clamping point are apparent from FIG. 6 and are described later. Mounted onto the extension tubes 4 are column fixtures 5 which in turn can be fixed on the extension tubes 4 by adjusting screws 6. These adjusting screws 6 can be both knurled screws which can be screwed on by hand and headless, hexagon socket screws which can be tighted with a socket wrench. The lower ends of the column fixtures 5 can be connected by a transverse linkage 7, which has retaining sleeves 8 at its ends into which the lower ends of the said extension tubes 4 engage, and in this way stabilize the column structure 1, 4, 5. On their upper end, the column fixtures 5 bear a shaped clothes hanger 9 which can be designed, for example, according to FIG. 10.

FIG. 1*c* shows how an individual suit can be presented on the decorative clothes stand according to FIGS. 1*a*, 1*b*. In this case, the tubular columns 1 pass through the trouser legs of this suit, and the trousers 10, e.g. in the waistband area, can be hung from the transverse linkage 7. The height of the column fixtures 5 supporting the shaped clothes hanger 9 can be adjusted by the adjusting screws 3 and 6 respectively, engaging into the column elements 1, 5, in such a way that the jacket 11 can be placed at the correct wearing height with respect to the trousers 10.

Each of the column fixtures 5, in a similar manner to FIG. 5*a*, could of course be provided with a shaped clothes hanger 9 sitting in an "overhung" manner in order to decorate, for example, two individual jackets 11.

In FIGS. 2 and 3, embodiments of the lower parts of column structures are shown in which in each case column pairs 1.1 are fixed as a single pair (FIG. 2) or as a twin pair (FIG. 3) on a base plate 12 which in turn is mounted on the bottom plate 2. Moreover, the column pairs 1.1 can be provided with firmly inserted, bottom simple cross pieces 13, e.g. for shoe supporting rests according to FIGS. 4*a–c* and/or double cross pieces 14, e.g. for bracket bearing arrangements 18 according to FIG. 8*b*.

In FIGS. 4*a, b* and 5*a, b*, decorative clothes stands according to the invention are shown which can be based on column structure according to FIG. 3. In FIGS. 4*a, b*, for example, on the front column pair 1.1', a trouser hanger 15 (FIGS. 7*a*, 7*b*) and a tie hanger 16 (FIGS. 9*a*, 9*b*) are in each case arranged on one of two columns 1. On the other hand, on the associated rear column pair 1.1.'', a shirt tray 17 is hung on the cross pieces 14'' by means of the bracket bearing arrangement 18 (FIGS. 8*a*, 8*b*), whereas the front cross pieces 14' are occupied by a flat tray 19 (FIG. 11). Moreover, the rear column pair 1.1'' bears a shaped clothes hanger 9 via the extension tubes 4 and the column fixtures 5, and the bottom single cross pieces 13 of both column pairs 1.1', 1.1'' support a shoe tray 20.

The corresponding decorative variant according to FIG. 4*c* shows a pair of trousers 21 laid over the trouser hanger 15, ties 22 hung into the tie hanger 16, a pullover 23, laid on the flat tray 19, a shirt 24 presented on the shirt tray 17, a jacket 11 supported on the shaped clothes hanger 9, and a pair of shoes 25 laid on the shoe tray 20.

The construction of the decorative clothes stand shown in FIGS. 5*a* and 5*b* is adapted for presenting two jackets 11.1 and 11.2 (FIG. 5*c*) each of which has allocated to it a pair of trousers 21.1 and 21.2 respectively and a pullover 23.1 and 23.2 respectively and a shirt 24.

Accordingly, the front column pair 1.1' of the decorative clothes stand from FIGS. 5*a* and 5*b* is equipped with in each case two trouser hangers 15.1, 15.2 and flat trays 19.1, 19.2, the latter being hung on the cross pieces-14' via respectively "left hand" and "right hand" bracket bearing arrangement 18.1, 18.2. As in FIG. 4*b*, the shirt tray 17 is arranged on the transverse members 14'' by means of a bracket bearing arrangement 18. Finally, each column fixture 5 bears a shaped clothes hanger 9 which is mounted thereupon in an "overhung" manner and on which a jacket 11.1, 11.2 is presented in each case.

Described below in embodiments are in each case means of designing the extension of the tubular columns 1 or the column pairs 1.1 and examples of attachment elements which can be erected on the tubular columns 1 or on the column pairs 1.1, 1.1'' in such a way that they can be dismantled and which are preferably suitable for the embodiments of the decorative clothes-stand according to the invention shown in FIGS. 1 (*a, b*) to 5 (*a, b*).

FIG. 6*a* shows the type of connection between the tubular columns 1; 1.1, fixed on the bottom plate 2 (FIGS. 1–3), and the column fixture 5 via the extension tube 4. The upper end of each tubular column 1; 1.1 is provided with a threaded bore 26, and so too is the lower end of each column fixture 5 and if necessary also the upper end of the column fixture. The extension tube 4 is provided at intervals with penetrations 27 through which the adjusting screws 3 and 6 respectively inserted into the threaded bores 26 extend and locate in a secure position the [lacuna] inside the tubular columns 1; 1.1 and in the column fixture 5.

FIG. 6*b* shows in an enlarged scale the sectioned lower end of the column fixture 5 as an example for the design of the column ends (circled section in FIG. 6*a*), [lacuna] pressed into the free end of a tubular column 1; 1.1 or the ends of a column fixture is an end sleeve 28 stepped in diameter, the maximum diameter of which corresponds to the outside diameter of the column and its inside width is of such a size that the extension tube 4, with a sliding fit, can be moved longitudinally therein. If necessary, the head 28' of the end sleeve 28 can be made so long that it can also be used as an outer guide section for mounting attachment elements to be placed onto the column end or the end of the column fixture. In this respect see the shaped clothes-hanger 9 according to FIG. 10. In this case, the tube surface 5' can be provided with a more-resistant (not shown) layer which is also able to fulfill decorative tasks.

FIGS. 7*a* and 7*b* show design forms of trouser hangers as can be used in conjunction with any column structures according to FIGS. 1 to 5. In FIG. 7*a* is a hanger tube 29 with two bearing tubes 30 attached symmetrically and at the spacing of the tubular columns 1; 1.1. The trousers 21, as shown by the broken line, are expediently placed in a uniformly distributed manner over the hanger tube 29 in such a way that both tubular columns 1; 1.1 can be covered with it. FIG. 7*b* shows an asymmetric embodiment of the trouser hanger 15 as used in FIGS. 4 (*a–c*) and 5 (*a–c*), and the hanger tube 29' is supported by a single eccentrically attached bearing tube 30'.

FIG. 8 shows the arrangement of a shirt tray 17 together with a shirt tray support which, for example, like the bracket bearing arrangement 18 in FIGS. 4*b* and 5*b*, can be hung onto the double cross-pieces 14'' on the rear column pair 1''. A supporting plate 31 is provided for hanging which has an upper bend 31', which embraces the upper cross-piece over about 180° of its periphery, and a lower bend 31'' which grips beneath the low crosspiece over about 90°. The supporting plate 31, on its side remote from the column pair 1'', bears a bracket 32, on the front of which a clamping sleeve 33 in the form of a vertically oriented tube piece is fixed. In the bore of the clamping sleeve 33, a bearing bar 34 is secured in a vertically adjustable manner, on the upper end of which the tray plate 35 is attached. The bearing bar 34 is held in the clamping sleeve by means of an adjusting screw 6.

FIGS. 9*a*, 9*b* show a tie hanger 16 in side view and plan view in its mounted position on a tubular column 1 or 1.1, It is fixed on the upper end of the tubular column by means of a slip-in pin 36 which can be firmly clamped in the column bore by an adjusting screw 6. Erected on the slip-in pin 36 is a retaining frame 37, 37' which is closed in on itself, and, as shown by the solid line (37), lies horizontally or, as shown by the broken line (37'), is inclined downwards.

The shaped clothes hanger 9 as shown in FIGS. 10*a–d* for presenting jackets has as a basic element a plastic hollow body 3 which is made in a bust shape and is preferably produced in a thermoplast rotational process. The hollow body 38 is provided with two outer mounting openings 39, arranged symmetrically to the v vertical hanger axis X—X, and one middle mounting opening 40 lying in the plane of the hanging axis X—X, all three of which open downwards. Both the outer mounting openings 39 and the middle mounting opening 40 are lined with reinforcing sleeves 41 and 42 respectively (the latter with an upper screwed connection piece 42'), and all mounting openings 39, 40 can be selectively made (before shaping of the hollow body) for mounting the shaped body onto a column fixture 5 (mounting opening 40). The outer mounting sleeves 39 are expediently always spaced apart by a distance which corresponds to the spacing of the tubular columns 1 so that decorative clothes stands of the type shown in FIGS. 1*a* and 4*a* can be constructed. The central neck part 9.1 of the shaped clothes hanger 9 can be designed in such a way that it can be provided, in particular for decorative purposes, with an interchangeable casing 43, also termed neck casing below. For this purpose, the neck part of the hollow body 38 is provided with an upper flat section 44 into which a cup-shaped recess 45 open at the top is formed. The recess 45 is provided with a lining sleeve 46 into which a slip-in pin 47, directed axially downwards on the inside on the neck casing 43, can be brought into locking relationship. The interchangeable neck casing 43 can be adapted in both its colour and its shape to specific decoration requirements.

Figure 10A:
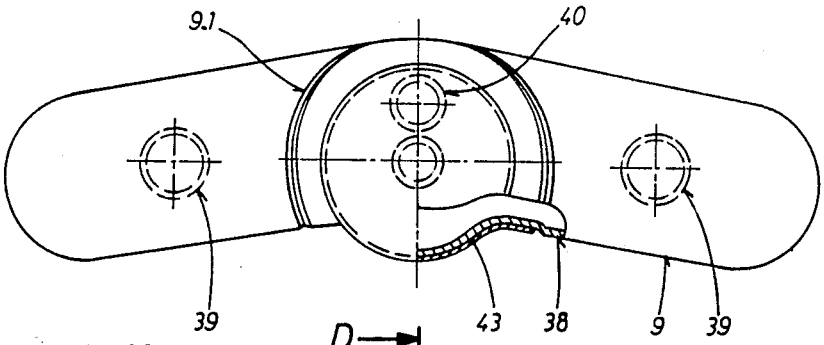
Figure 10B:
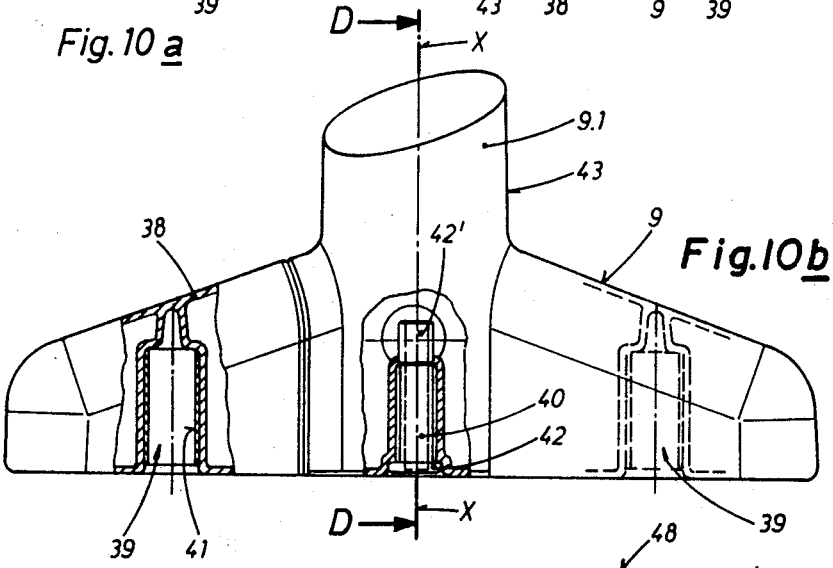
Figure 10C:
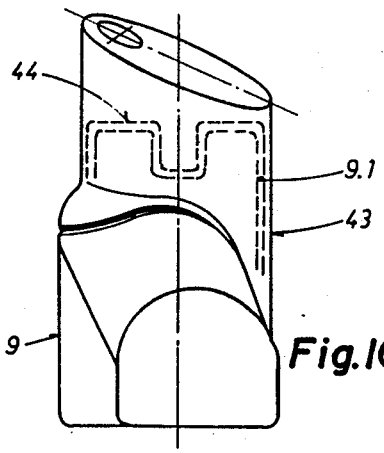
Figure 10D:
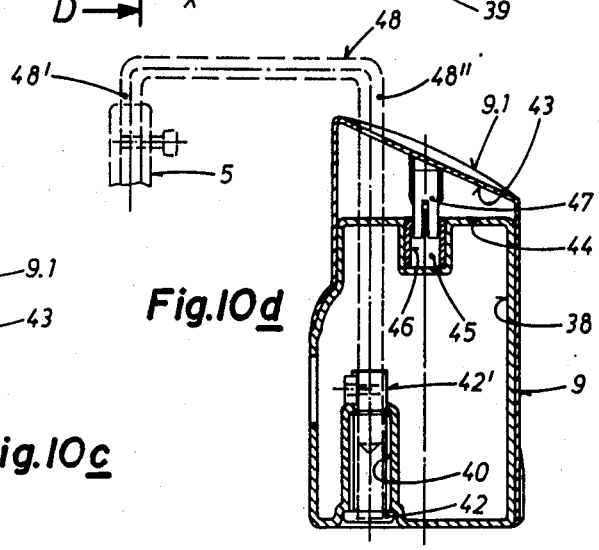

Whereas the shaped clothes hanger was hitherto always to be understood as a slip-on part which was to be mounted directly onto a column fixture 5 or onto an extension tube 4, FIG. 10*d* shows an assembly varient which is shown by a broken line and has a suspended support 48 bent approximately in an inverted U-shape. One leg 48' of the suspended support 48 can be clamped into the upper end of a tubular column or a column fixture 5, and its other leg 48'' passes from above through openings (not shown) in the neck casing 43 and in the flat section 44 of the hollow body into the middle mounting opening 40. The screwed connection piece 42' present there on the reinforcing sleeve 42 enables the shaped clothes hanger 9 to be clamped on the suspended support 48 in self-supporting manner.

The front tray 19, which, for example, can be used for presenting a pullover, is shown in FIG. 11 as a further attachment element of the decorative clothesstand according to the invention. A bracket 50, which bears a tray plate 51 in a symmetric (not shown) or asymmetric arrangement (on the left or right side), is on a supporting plate 49 which in principle can be of the same design as the supporting plate 31 in FIG. 8 and can be hung into the double cross pieces 14'.

FIG. 12 shows the shoe tray 20, already known from FIG. 4*b*, in the assembly position on the single cross pieces 13 between two column pairs 1.1' and 1.1''. Integrally formed on the upper end of the flat tray, expediently made from a sheet-metal section, is a suspension channel 52 which embraces in a tilt-resistant manner the upper rear single cross piece 13. The lower end of the shoe tray provided with a stop rib 53 sits on the lower front single cross piece 13.

Finally, FIG. 13 shows a means of connecting two decorative clothes stands designed according to the invention by a connecting tray 54. This connecting tray 54 is located between two tubular column structures of the paired embodiment which are disposed relative to one another as supporting members in an exactly parallel alignment and at a predetermined spacing. On a frame supporting a tray plate 57, hanging members 55, which consist of flat stop strips 58 directed vertically downwards and safety hooks 59 bent at the upper end of the flat stop strips 58, are fixed on frame sides located opposite one another. The safety hooks 59 approximately correspond to the bends 31', integrally formed at the top on the supporting plate 31 in FIG. 8, to enable the connecting tray 54 to be hung.

I claim:

1. A decorative clothes stand for displaying clothing comprising:

a bottom element at least two column members standing on said bottom element at or on which an attachment element for presenting articles of clothing is removeably fixed, at least one cross piece distancing and connecting together two of said column members, each said column member having an extension tube, a column fixture and a tubular column, a sleeve member provided at each end of each said extension tube and tubular column, each sleeve member having a clamping section with a sleeve bore having an inside diameter equal to the outside diameter of the extension tubes and a head section having the outside diameter set to the outside diameter of the tubular columns, each said sleeve bore of said clamping section of said sleeve member capable of receiving said extension tube for extending the length of said column member, and capable of receiving a supporting member on which said attachment element is fixed, wherein each end of said extension tube is inserted into the sleeve bore of said column fixture and said tubular column, respectively, to form a column member of said clothing stand, wherein the attachment element comprises a shaped clothes hanger shaped like a bust and comprising a plastic hollow body with downwardly open mounting openings for accommodating tubular column ends, wherein two mounting openings are available which are arranged at the spacing of the tubular columns and their inside diameter is adapted to the outside diameter of the tubular columns, and wherein a further mounting opening is available which lies in a plane of the central vertical axis of said stand, and its inside diameter is adapted to the outside diameter of an extension tube in one of the tubular columns and is provided with means for firmly clamping the shaped clothes hanger on the extension tube.

2. The decorative clothes stand as claimed in claim 1, wherein each extension tube is provided with a plurality of wall penetrations made at predetermined intervals for accommodating an adjusting screw.

3. The decorative clothes stand as claimed in claim 1, wherein a neck part (9.1) of the shaped clothes hanger (9) is provided with a casing (43) which can be removed from the shaped clothes hanger (9) and is made of a material differing from the material of the plastic hollow body (38) and wherein this casing (43) is held on the hollow body (38) by a centering and slip-in device (45-47) formed into the neck part (9.1).

* * * * *